United States Patent [19]

Ross

[11] Patent Number: 4,530,299

[45] Date of Patent: Jul. 23, 1985

[54] COLLAPSIBLE WIND SURFING VESSEL

[76] Inventor: Alan Ross, 2400 E. 23rd St., Signal Hill, Calif., 90806

[21] Appl. No.: 629,568

[22] Filed: Jul. 10, 1984

[51] Int. Cl.[3] ..... B63B 35/00

[52] U.S. Cl. ..... 114/39; 114/90; 114/97; 114/352; 114/61; 441/74

[58] Field of Search ..... 114/39, 39.2, 61, 90, 114/97, 352, 353, 354; 441/74

[56] References Cited

U.S. PATENT DOCUMENTS

| | | | |
|---|---|---|---|
| 3,287,754 | 11/1966 | Price et al. | 441/74 |
| 3,409,920 | 11/1968 | Brownley | 441/74 |
| 3,577,576 | 5/1971 | Lobb | 441/74 |
| 3,839,979 | 10/1974 | Wassell | 114/354 |
| 3,883,909 | 5/1975 | Fisher et al. | 114/61 |
| 3,996,868 | 12/1976 | Schagen | 114/352 |

*Primary Examiner*—Jesûs D. Sotelo
*Attorney, Agent, or Firm*—Jack C. Munro

[57] ABSTRACT

A wind propelled surfboard which has a catamaran hull wherein each hull can be folded to a collapsed position. Also, the mast and boom are capable of being folded when into a collapsed position when not in use.

14 Claims, 25 Drawing Figures

COLLAPSIBLE WIND SURFING VESSEL

BACKGROUND OF THE INVENTION

The field of this invention relates to a sail surfing vessel which uses a sail for propulsion and more particularly to constructing of the sail surfing vessel so as to be collapsible in a substantially smaller space when not in use in order to facilitate portability from one location to another.

Surfboards have long been known and used by many in the engagement of the water hobby known as surfing. Within recent years, the usage of the surfboard has been extended to include a sail. Therefore, instead of the surfboard being propelled totally by the waves, the board can now be propelled by the air in a manner similar to that of a sailboat.

The conventional sail surfboard takes the form of a conventional surfboard which is usually constructed of plastic, foam and fiberglass as an integral unit which is generally between eight and twelve feet in length. There is also utilized in conjunction with the board a mast that is again somewhere in the range of around fourteen to sixteen feet in length. There is also utilized a boom which connects to the mast which is generally in the range of six to nine feet in length. Because of the elongated nature of all the parts and since it is usually necessary to have the board be transported to the location of where it will be used, it is necessary to obtain a specific form of transportion device in order to transport the sail surfboard to its desirable location. Typical transportation devices would be a station wagon, van or truck. If it is desirable to transport the sail surfboard by automobile, it is generally necessary to install a luggage rack on the top of the automobile with the sail surfing board being attached thereto during transportation.

The storage and transportion problems associated with the sail surfboard, due to their considerable length, inhibits the practice of the sport. Carrying of a board on the exterior of an automobile makes it highly susceptible to loss by theft when the automobile is left unattended. Also, the sail surfboard is susceptible to damage because of failure of or accidental dislodgement from the luggage rack. Still further, it is difficult and expensive to carry one's surfboard on public modes of transportion. By way of a specific example, there is normally a significant extra fee charged by an airline to transport a sail surfing board.

In the past, there have been attempts at designing collapsible sail surfboards. However, the collapsible sail surfboards of the prior art have been complex in construction and require a significant amount of assembly work prior to usage. An example, of a sail surfing board of the prior art, is shown within the U.S. Pat. No. 3,996,868, issued to Fritz Schagen, entitled "Wind Surfer", issued Dec. 14, 1976.

There is a need to construct a sail propelled surfboard which is composed of few parts and can be quickly and easily folded to a collapsed position, is light in weight therefore facilitating personal carrying, and also is strong and capable of incurring a significant amount of abuse while experiencing little or no damage.

SUMMARY OF THE INVENTION

The sail surfing vessel of the present invention utilizes a catamaran configuration which is composed of a pair of twin hulls which are located in a spaced, side-by-side relationship. Each hull is constructed substantially identical and has a basic triangular shape in transverse cross-section. Each hull is constructed of a front section and a rear section each of which are connected to a center section. The front section of each hull is hingedly connected along one of the triangular sides to the center section. The rear section is also hingedly connected to the center section along another of the triangular sides. Both the front section and the rear section are to be hingedly folded (when not in use) and be located against the center section. Because both the front and rear sections are hinged to different sides of the triangle, the front and rear section do not interfere with one another. A frame assembly, which is also hinged at a hinge axis substantially along the longitudinal center axis of the frame assembly, is to also be folded when not in use. One side edge of the frame assembly is to be fixedly secured to the center section of one hull with the other side edge of the frame assembly to be fixedly secured to the center section of the other hull. Fixedly securing of the frame assembly to each of the hulls is through the use of a locking detent mechanism. The frame assembly includes an elongated slot which is generally oriented in substantial alignment along the hinging axis of the frame assembly. Within the elongated slot is located a mounting plate assembly. The mounting plate assembly can be moved and fixed in position to the frame assembly at any desired location within the length of the elongated slot. A mast is to be universally connected to the mounting plate assembly. The mast is formed of a plurality of segments with the different segments being hinged together. The segments are to be located in a substantially in-line position when the mast is in use. The hinging connection of each of the mast segments is such that hinging motion can only occur in one direction and is limited to approximately 180 degrees. Hinging motion in the opposite direction is prevented which therefore holds the mast in a rigidly extended position with the sail mounted on the mast. A boom is attached to the mast and extends around the sail. The boom comprises an elongated tubular shaped structure composed of a fore section and an aft section. The fore section attaches to the mast and is basically in the shape of a wishbone configuration. The aft section is also in a shape of a wishbone configuration and is located about the free outer edge of the sail. The aft section is hingedly connected to the fore section. With the hinges located in vertical orientation, the aft section can be pivoted to be in juxtaposition with the fore section. The hinges also can be pivoted to a substantially horizontally oriented position which will prevent folding of the aft section onto the fore section and form the boom as a rigid unit.

The primary objective of the present invention is to construct a sail surfing vessel which can be readily disassembled to be locatable within a relatively small space in order to facilitate transportation from one location to another within a conventionally available transporting vehicle such as a trunk of a car.

Another objective of this invention is to construct a sail surfing vessel that can be quickly and easily assembled by even the most unskilled individual.

Another objective of this invention is to construct a sail surfing vessel that is constructed with relatively few parts and therefore can be manufactured inexpensively.

Another objective of this invention is to construct a sail surfing vessel that is light in weight and can be carried as easily by women as by men.

DETAILED DESCRIPTION OF THE SHOWN EMBODIMENT

Figure 1:
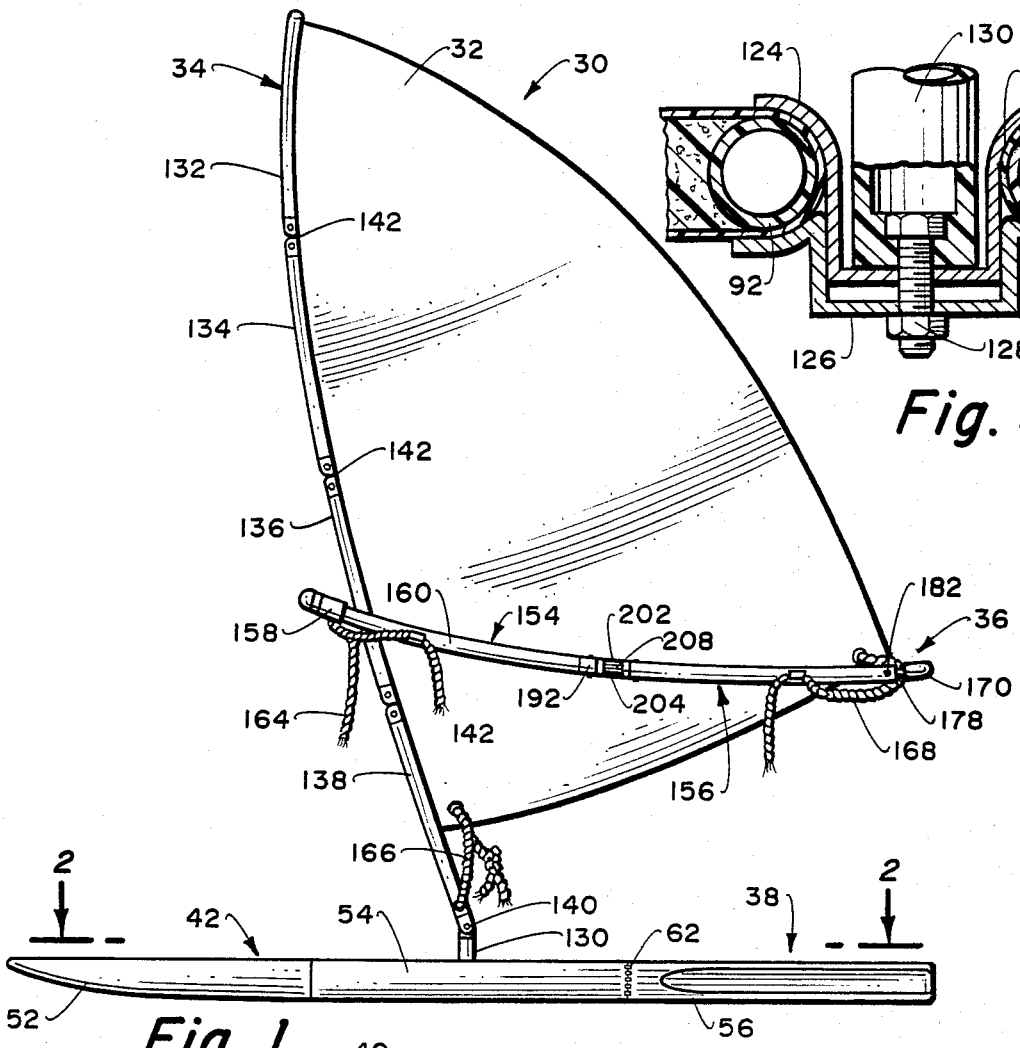
FIG. 1 is a side elevational view of the sail surfing vessel of the present invention in its normal use configuration.
Figure 3:
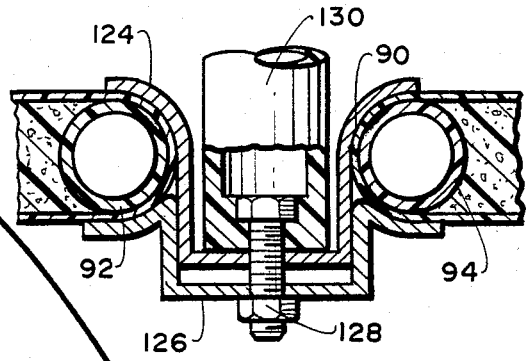
FIG. 3 is a cross-sectional view through the mast connection assembly between the mast and the hull of the sail surfing vessel of the present invention taken along line 3—3 of FIG. 2.

Referring particularly to the drawings there is shown a sail surfing vessel 30 of this invention composed generally of a sail 32, a mast 34, a boom 36 and a hull assembly 38. The hull assembly 38 is formed of a pair of twin hulls 40 and 42 which are connected through a frame assembly 44. The hulls 40 and 42 form basically a catamaran hull configuration since the hulls 40 and 42 are located in juxtaposition and in a spaced-apart parallel relationship in respect to each other. It is to be understood that each of the hulls 40 and 42 have a longitudinal center axis which extends centrally from the rearmost edge of each hull to the forward tip of each hull.

Figure 9:
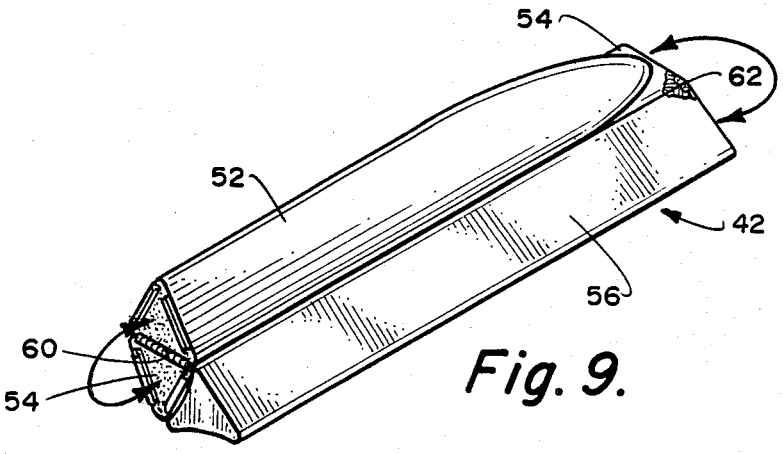
FIG. 9 is an isometric view of one of the hulls of the sail surfing vessel of this invention showing the hull in a collapsed position.

Hull 40 is composed of a front section 46, a center section 48 and a rear section 50. In a similar manner the hull 42 is formed of a front section 52, a center section 54 and a rear section 56. The front section 46 is hingedly connected by hinge assembly 58 to the center section 48. In a similarly hinged manner the front section 52 is connected through a hinge assembly 60 to the center section 54. A similar type of hinge assembly 62 hingedly connects through section 56 to center section 54. However, it is to be noted in observing FIG. 9 that the hinge 62 is mounted along one edge of the triangularly shaped end cross-section of center section 54 while the hinge 60 is mounted about another of the triangularly shaped edges. This is so that when the front section 52 folds up alongside and against the center section 54, that when the rear section 56 similarly folds up, that the sections 56 and 52 do not interfere with one another and a compact folded hull 42 results.

It is to be understood that the hinge 58 is basically identical to hinge 60. It is also to be understood that a hinge similar to hinge 62 will be incorporated within the hull 40 between the rear section 50 and the center section 48. It is also considered to be important for minimizing drag of the movement of the hulls 40 and 42 through the water that the construction of the hinges 58, 60 and 62 are to be flush with the exterior surface of each of the sections of the hulls 40 and 42. It is further to be understood that the hinges 58, 60 and 62 will normally take the form of what is frequently termed a "butt hinge" which utilizes two separate pins 64 and 67 as opposed to a single pin type of butt hinge. The use of the two pins is necessary in order for each of the sections 52 and 56 to pivot 180 degrees in order to rest against the surface of the center section 54 or 48.

Figure 2:
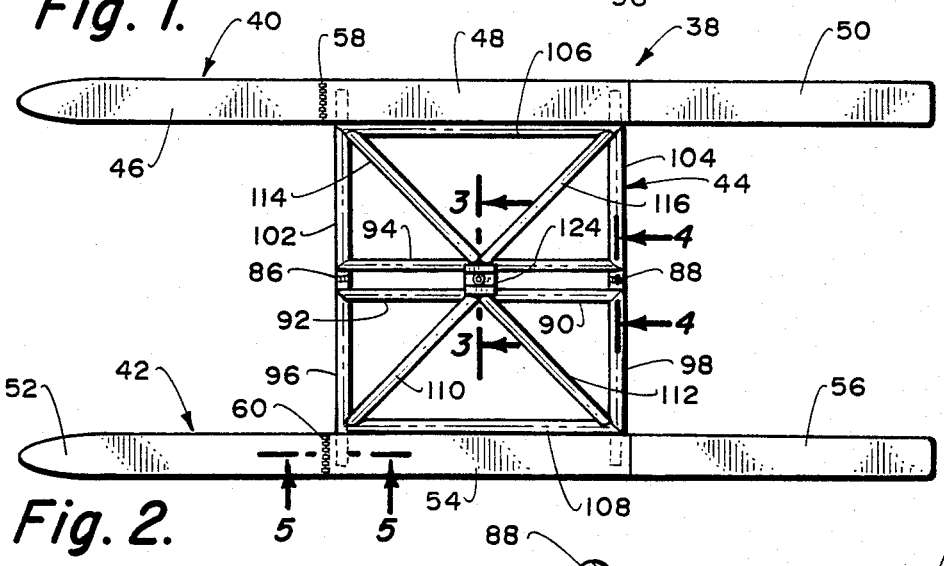
FIG. 2 is a top plan view of the catamaran hull assembly utilized within the sail surfing vessel of this invention taken along line 2—2 of FIG. 1.
Figure 4:
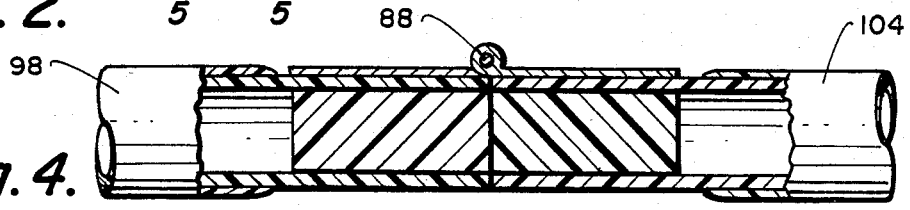
FIG. 4 is a cross-sectional view taken along line 4—4 of FIG. 2 showing the hinging arrangement incorporated within the frame assembly of the sail surfing vessel of the present invention.
Figure 5:
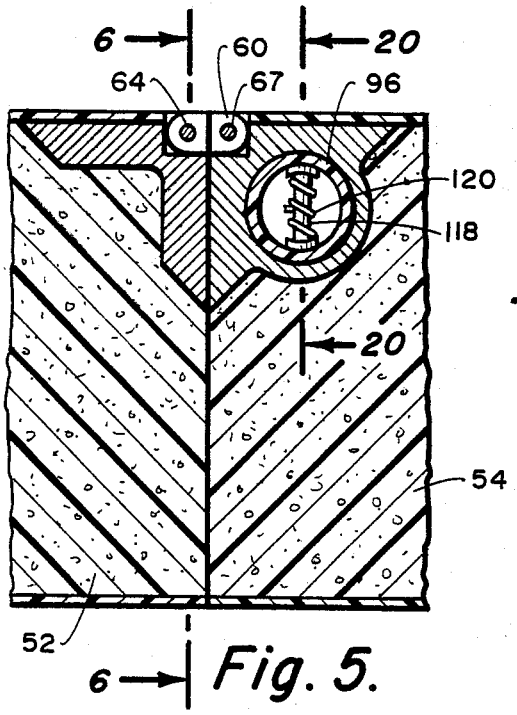
FIG. 5 is a cross-sectional view taken along line 5—5 of FIG. 2 showing the hinging arrangement incorporated within the twin hulls of the sail surfing vessel of the present invention.
Figure 6:
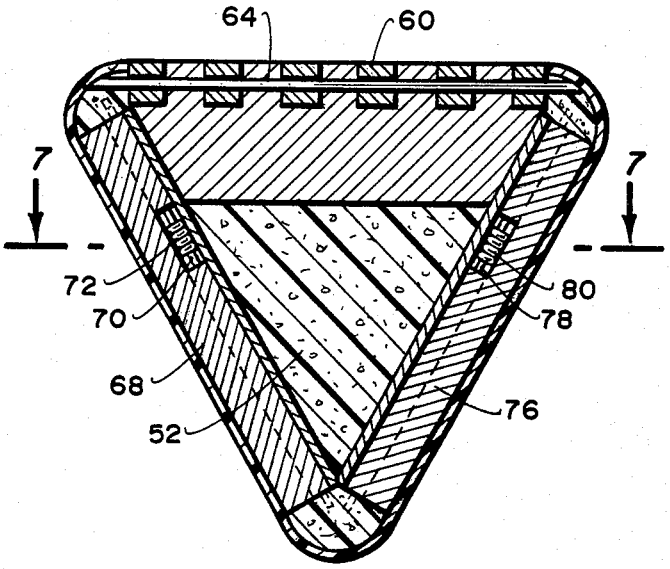
FIG. 6 is a cross-sectional view through one of the front sections of one of the hulls incorporated in the sail surfing vessel of the present invention taken along line 6—6 of FIG. 5.
Figure 7:
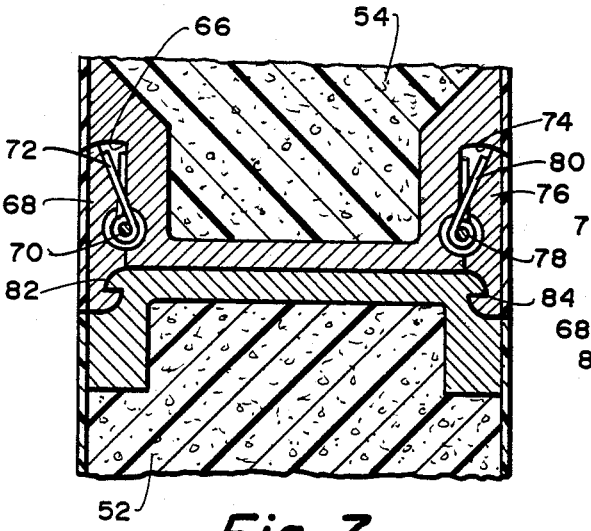
FIG. 7 is a cross-sectional view taken along line 7—7 of FIG. 6 showing the latching assembly utilized in conjunction with each of the hulls to lock in position different sections of the hull when the sail surfing vessel is being used.
Figure 8:
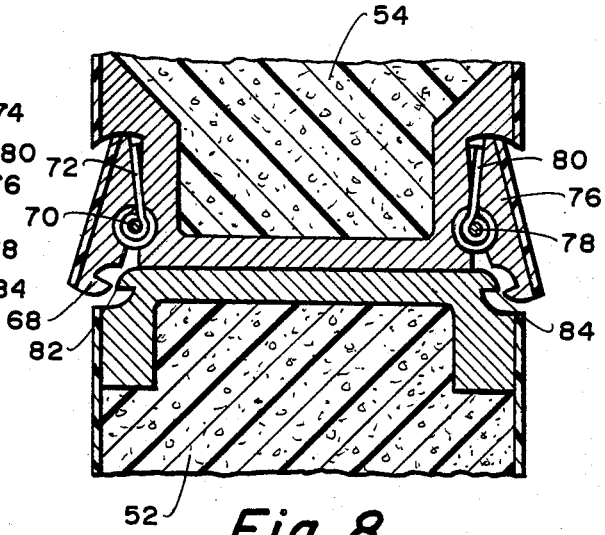
FIG. 8 is a view similar to FIG. 7 but showing the latching assembly in the unlatched position as opposed to the latched position shown within FIG. 7.

When the hulls 40 and 42 are in their extended usable position as shown in FIGS. 1 and 2 of the drawings, it is required that a positive form of latching device be utilized to securely maintain in position each of the hulls 40 and 42. Mounted within a recess 66 formed within the center section 54 is a hook latching bar 68. The hook latching bar 68 is pivotable about a pin 70 between a latched position shown in FIG. 7 to an unlatched position shown in FIG. 8. The hook latching bar 68 is continuously spring biased by spring 72 toward the latched position.

Also mounted within a recess 74 within the remaining free side edge of the center section 54 is a latching bar 76. The latching bar 76 is pivotally mounted on a pin 78. The latching bar 76 is also continously spring biased by means of a spring 80 to the latched position. Basically, the latching bars 68 and 76 are identical, but are located in a facing relationship with respect to each other.

The latching bar 68 is to engage with latching awl 82 which is mounted on the inner end of front section 52. The latching bar 76 also is to connect with a latching awl 84 formed within the front end of the front section 52. Simultaneous unlatching movement of the latching bars 68 and 76 is required to the position shown within FIG. 8 in order to permit the front section 52 to be pivoted relative to the center section 54 to the position shown in FIG. 9. It is to be understood that there will be a similar set of latching bars associated with the connection between the center section 54 and the rear section 56, the center section 48 and the rear section 50 and the center section 48 and the front section 46.

It is also considered to be within the scope of this invention that each of the hulls 40 and 42 will be constructed primarily of a plastic foam material which is covered by either a plastic covering or a fiberglass covering. The hulls 40 and 42 are to be sufficiently bouyant so as to not only cause the sail surfing vessel 30 to float within water, but also float with the addition of the body weight of a conventional human being.

Figure 20:
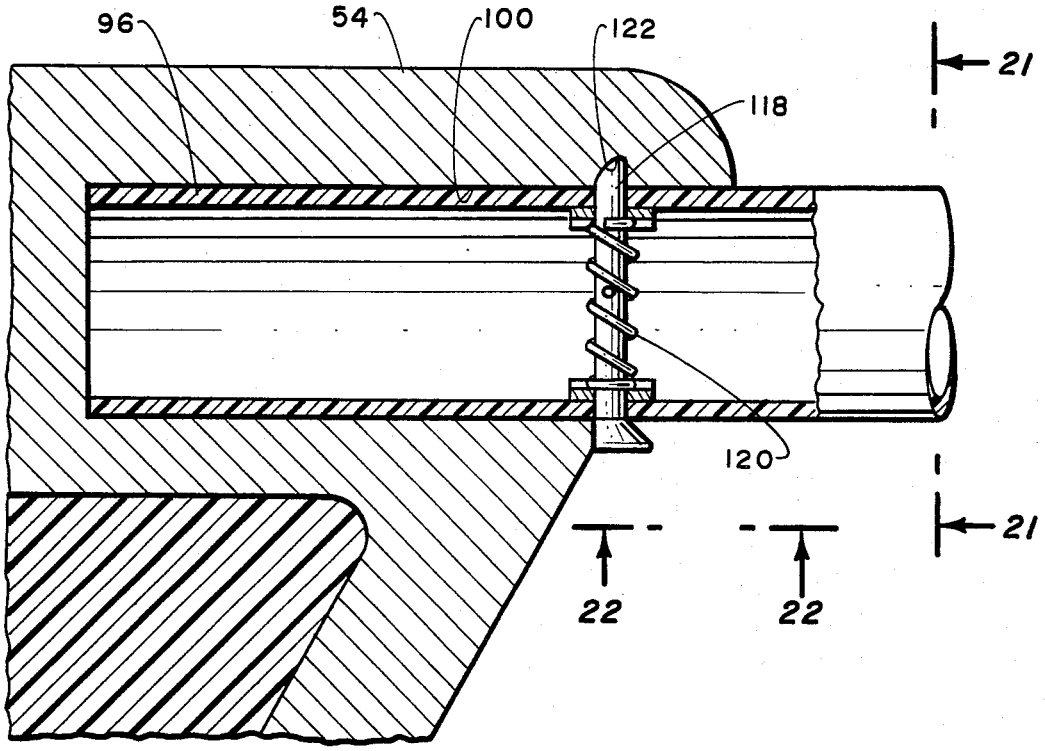
FIG. 20 is a cross-sectional view through a locking detent utilized in conjunction with the hull included within the vessel of the present invention taken along line 20—20 of FIG. 5.
Figure 21:
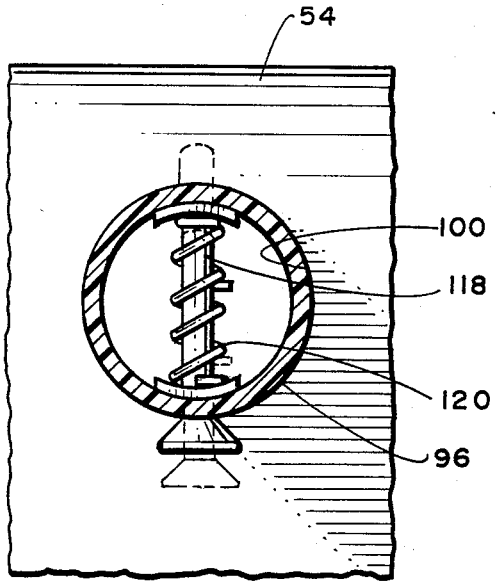
FIG. 21 is a view, partly in cross-section, taken along line 21—21 of FIG. 20 showing in more detail the locking detent.
Figure 22:
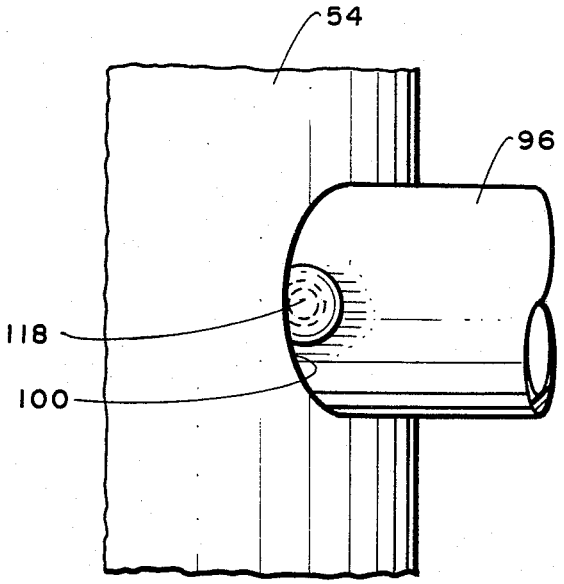
FIG. 22 is an end view of the locking detent taken along line 22—22 of FIG. 20.

The frame assembly 44 is divided into two separate side sections which are hinged together by hinges 86 and 88. The hinges 86 and 88 are located at the substantial center of the width of the frame assembly 44. Located between the hinges 86 and 88 is an elongated slot 90 which is closed on the sides by tubular members 92 and 94. Attached to members 92 at each end thereof are a pair of transverse supporting tubes 96 and 98. The free outer end of each of the tubes 96 and 98 fit within mating recesses formed within the center section 54. One such mating recess is shown within FIG. 20, that being recess 100. It is to be understood that a similar pair of transverse tubular members 102 and 104 connected with tubular member 94. The free ends of members 102 and 104 also extend within mating recesses formed within the center section 48. Connected to members 102 and 104 directly adjacent the hull 40 is a longitudinal member 106. A similar longitudinal member 108 connects members 96 and 98 directly adjacent the hull 42. Connecting member 92 and members 96, 98 and 108 are a pair of cross tubes 110 and 112. A similar pair of cross tubes 114 and 116 inner connect members 94, 102, 104 and 106. The tubes 110, 112, 114 and 116 function as bracing means for a planer supportive surface mounted on and completely covering the frame assembly 44 with the exception of the elongated slot 90. The individual using the sail surfing vessel 30 of this invention will normally stand on this planer supporting surface.

To insure that the free ends of the members 96, 98, 102 and 104 remain fixed within their respective center sections 54 and 48 during usage of the sail surfing vessel 30, a locking detent is included in conjunction with each member 96, 98, 102 and 104. Only one such locking detent is shown within FIG. 20 which takes the form of a pin 118 which is biased by a spring 120 to the innermost position shown in FIG. 20. The pin 118 is to be manually moved to a retracted position which moves the tip of the pin 118 out of recess 122 formed within the section 54. With the tip of the pin 118 out of the recess 122, the tubular member 96 can be readily disengaged from the opening 100 in order to separate the hulls 40 and 42 from the frame assembly 44.

Mounted within the opening 90 is a mounting plate assembly which could generally be referred to as a saddle bracket assembly. The mounting plate assembly is composed of an upper plate 124 and a lower plate 126. The plates 124 and 126 are connected together through a bolt fastener 128. Tightening of the bolt fastener 128 will cause the outer edges of the plates 124 and 126 to be moved toward each other and thereby bind onto tubular members 92 and 94. The plates 124 and 126 can be located at any longitudinal position within the slot 90 and once the desired position has been obtained due to wind surfing wave conditions, wind, as well as physical weight of the operator, the operator then securely tightens the bolt fastener 128 thereby fixing in position the plates 124 and 126.

The bolt fastener 128 also connects with a connecting rod 130. The lower free end of the mast 34 connects with the connecting rod 130 establishing a universal connection therebetween permitting three hundred sixty degree movement of the mast 34 relative to the frame assembly 44. This universal movement is accomplished by two axis movement of the mast 34 relative to connecting rod 130 and swiveling of the connecting rod 130 about the bolt assembly 128 relative to plates 124 and 126.

The mast 34 is constructed of four in number of separate substantially identical length segments 132, 134, 136 and 138. The connecting rod 130 is actually shown as part of the mast 34. The connecting rod is hingedly connected by a single pin hinge assembly 140 with the segment 138.

Figure 15A:
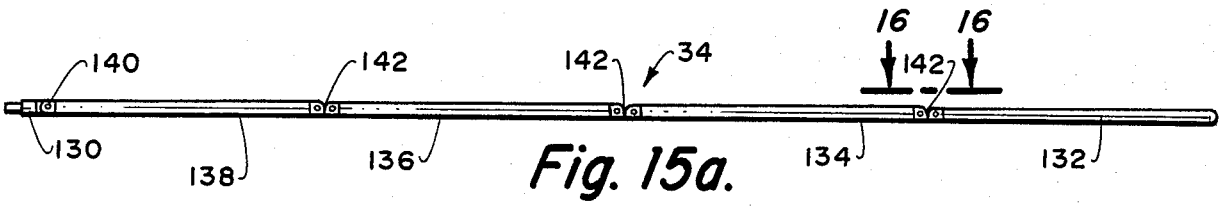
FIG. 15*a* is a side elevational view of the mast incorporated within this invention showing the mast in the totally extended or use position.
Figure 15B:
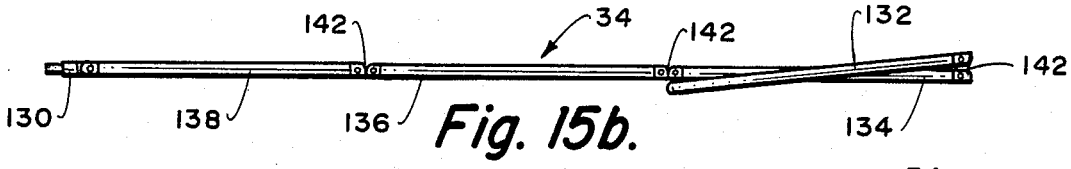
FIG. 15*b* is a view similar to FIG. 15*a* but showing the mast in the initial folding position.
Figure 15C:
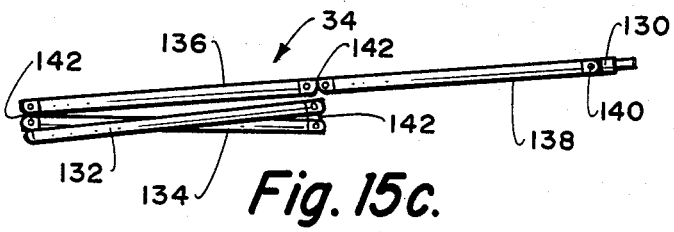
FIG. 15*c* is a view similar to FIG. 15*b* but showing the mast in a further intermediate folding position.
Figure 15D:
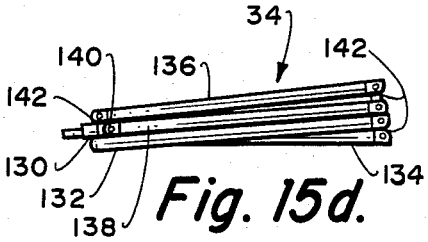
FIG. 15*d* is a side elevational view of the mast showing the mast in completely folded position.
Figure 16:
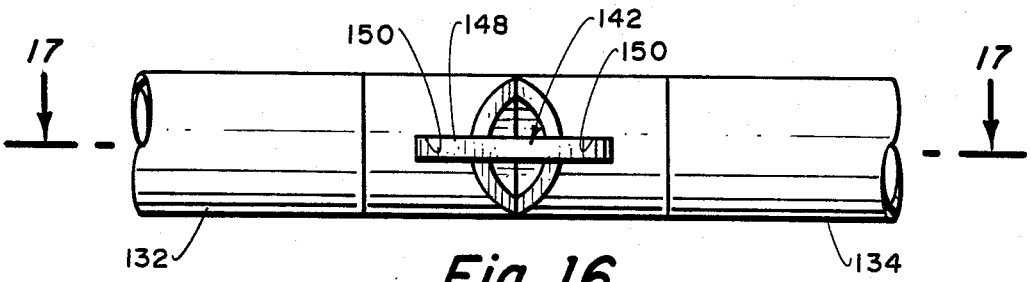
FIG. 16 is a view of one of the hinge assemblies included within the mast which is incorporated within the sail surfing vessel of this invention taken along line 16—16 of FIG. 15*a;*
Figure 17:
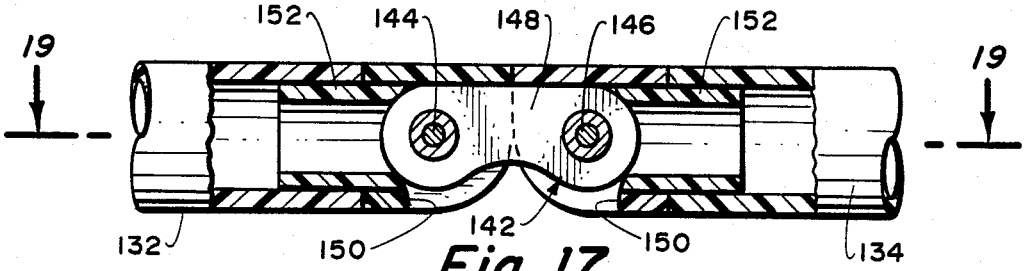
FIG. 17 is a cross-sectional view taken along line 17—17 of FIG. 16.
Figure 18:
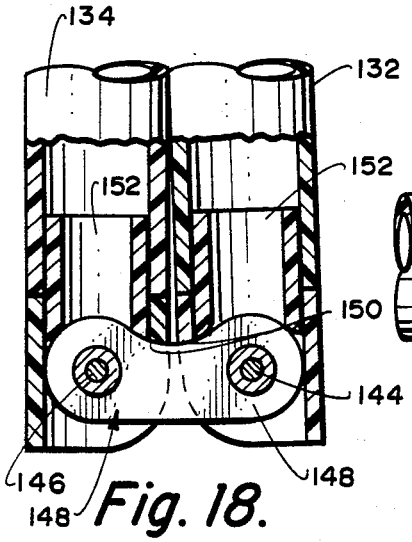
FIG. 18 is a view similar to FIG. 17 but showing the hinge in the folded position.
Figure 19:
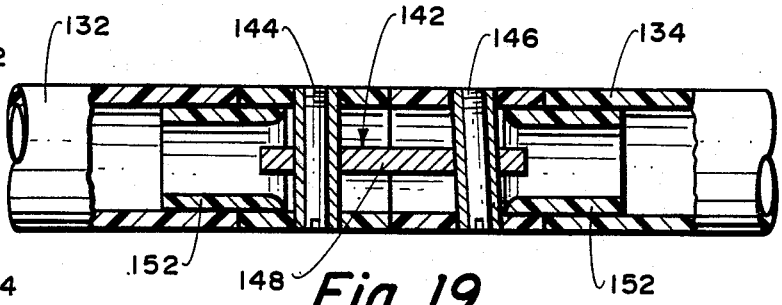
FIG. 19 is a cross-sectional view taken along line 19—19 of FIG. 17.

Connecting between segments 136 and 138, between segments 134 and 136, and also between segments 132 and 134 is a hinge 142. Each hinge assembly 142 is basically identical and generally what is termed as previously mentioned the double pin type of hinge utilizing pins 144 and 146. Connecting the pins 144 and 146 is a link 148. Within the leading section (directed into the wind) of each of the segments 132, 134, 136 and 138 there is a cutout section 150. Directly adjacent cutout sections 150 of adjoining segments 132, 134, 136 and 138 will operate together as is clearly shown in FIGS. 17 and 18 of the drawings. The purpose of the cutout sections 150 is to permit pivoting of the segments in a juxtaposition (abutting side-by-side rellationship) so that the mast 34 can be completely folded to the position shown in FIG. 15*d*.

However, it is to be noted that the trailing surface of the mast 34 (when the mast is extended) does not include any cutout sections. Therefore, any attempt to pivot the segments 132, 134, 136 and 138 in the direction toward the rear of the vessel 30 will not result in any pivoting action but will result in the mast 34 assuming a rigid extended configuration as is shown in FIG. 1. Actually there is a continual force being applied against the mast 34 in this direction by means of the sail 32 which is attached to this trailing surface of the mast 34.

It is to be noted that in the constructing of each of the hinge joints 32 that there is a strengthening sleeve 152 mounted within each of the tubular segments 132, 134, 136 and 138 directly adjacent each link 148.

In order to keep the sail 32 extended there is utilized the boom 36. The purpose of the boom is to be manually grasped by the operator in order to effect sailing of the vessel 30.

The boom 36 is constructed of a fore section 154 and an aft section 156. The fore section 154 includes a fore joint 158 from which at opposite ends thereof slightly arcuate tubular members 160 and 162. The fore joint 158 is to be attached by a rope 164 through the mast 34 generally at about segment 136. However, the exact vertical attaching point is to be varied depending upon the physical height of the operator. Also, it is to be noted that there is a rope 166 utilized to attach the lower end of the sail 32 to the lower end of the mast 34. There is also utilized a rope 168 to connect the aft joint 170 of the aft section 156 to the outer free edge of the sail 32 so that the sail 32 will remain in a completely expanded state so that it can "catch the wind".

Connected to the aft joint 170 and extending from either end thereof are a pair of tubular members 172 and 174. The connection between the joint 170 and the tubular member 172 is through a smaller diameter tube 176 which is telescopingly received within the tubular member 172. A similar smaller diameter member 178 is connected between the joint 170 and is telescopingly received in the member 174. A spring actuated button assembly 180 is mounted on the tubular member 176 and is capable of extending through a hole formed within the tubular member 172. A similar spring actuated button assembly 182 is mounted on the tubular member 178 and also is capable of extending through an opening formed within the member 174. Each of the buttons 180 and 182 can be manually depressed which will permit rotation of the member 172 relative to rod 176 and member 174 relative to rod 178. This rotation is permitted due to a pivot pin connection being established with segments 160 and 162. Only one of the pivot pin connections is shown since both are identical with that being the connection with segment 162.

The pivot pin connection comprises pin 184 which has at each end thereof enlarged heads 186 and 188. Enlarged head 186 connects with segment 162 while enlarged head 188 connects with short segment 90. A similar short segment 192 connects in a similar manner with a segment 160. Therefore, it can be seen that rotation of segment 172 will cause rotational movement between the short segment 190 and the segment 162. Similarly rotation of member 174 relative to rod 178 will cause rotation of the member 174 relative to the member 160.

There may be included in conjunction with the pin 184 a protuberance 194 which rides within a ninety degree slot 196 formed within the short segment 190. The pin 194 and the slot 196 function to limit the amount of movement of the member 172 relative to the member 162. A similar pin arrangement will be utilized in conjunction with the short segment 192. In actual practice it is only necessary that the members 172 and 174 be pivoted from the position shown in FIG. 10 to a ninety degree displaced position as shown in FIG. 11 with the direction of this pivoting motion being depicted by arrows 198 and 200.

Mounted on the short segment 190 are a pair of discs 202 and 204 which form a slight gap 206 therebetween. The discs 202 and 204 are fixedly mounted on the member 190. Fixedly mounted on the member 172 is a disc 208. The disc 208 fits in a close fitting manner within the gap 206. The disc 208 also has protruding from its exterior surface a sleeve 210 which is continuously outwardly biased in a protruding manner by means of a spring 212. The discs 202, 204 and 208 cooperate together to form a hinge assembly with it being understood that a similar hinge assembly will be connected between the short segment 192 and the member 174.

Figure 10:
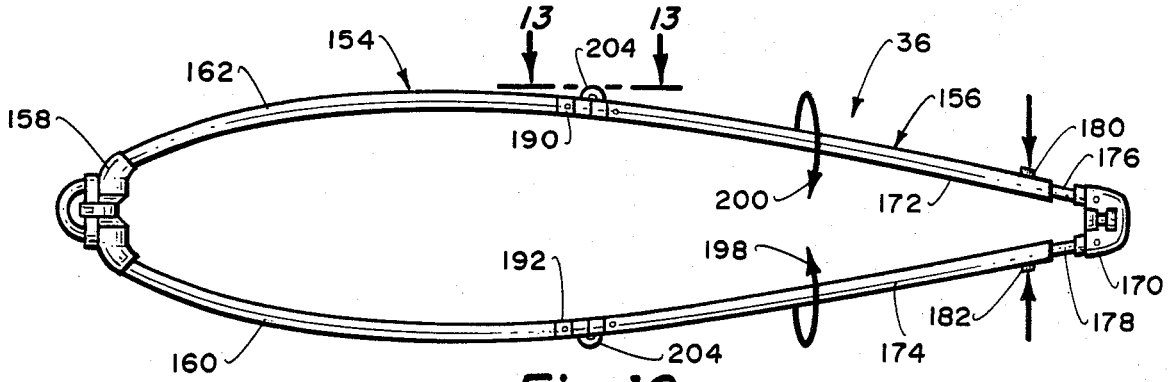
FIG. 10 is a top plan view of the boom utilized in conjunction with the sail surfing vessel of the present invention showing the boom in its normally use configuration.
Figure 11:
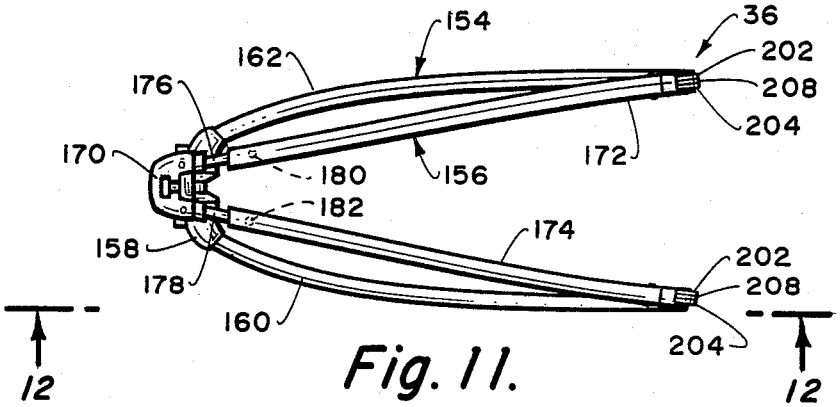
FIG. 11 is a view similar to FIG. 10 but showing the boom in the collapsed configuration.
Figure 12:
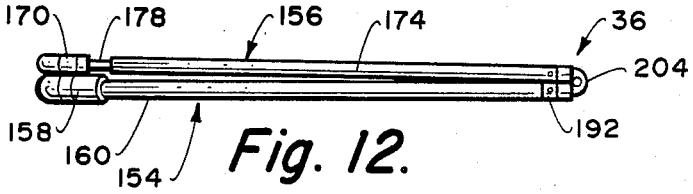
FIG. 12 is a side view of the boom of the present invention in the collapsed configuration taken along line 12—12 of FIG. 11.
Figure 13:
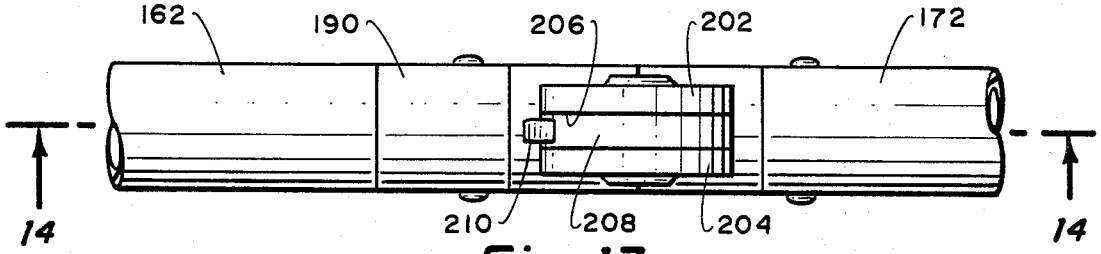
FIG. 13 is a side view of one of the hinge assembly used in conjunction with the boom incorporated within this invention taken along line 13—13 of FIG. 10.
Figure 14:
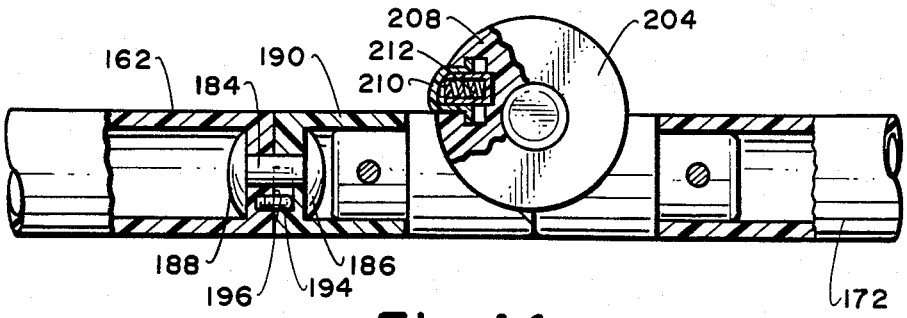
FIG. 14 is a cross-sectional view taken along line 14—14 of FIG. 13.

With the boom 36 located in the position as shown in FIG. 10, the boom 36 forms a rigid structure which surrounds the sail 32 and can be readily grasped by the operator to effect orientation of the sail 32 with respect to the wind and therefore propel the vessel 30 at the maximum or most desirable speed and direction. Where it is desired to fold the boom 36 into its flat state, the boom 36 is removed from connection with the sail 32 and the mast 34. The operator then depresses buttons 180 and 182 and then physically rotates the members 172 and 174 in the direction of their respective arrows 200 and 198. Until both members 172 and 174 are rotated totally ninety degrees which is determined by the protuberance 194 totally moving within the slot 196. The operator then can physically affect pivoting of the rear section 156 relative to the fore section 154 approximately 180 degrees until the aft section 156 is resting against the fore section 154 as is clearly shown in FIGS. 11 and 12 of the drawings.

What is claimed is:

1. A collapsible sail surfing vessel comprising:

an elongated hull composed of twin hulls located in a spaced-apart juxtaposition relationship, each said hull including first means for folding the said hull to assume a substantial decreased length when not in use, said hulls when in use being connected together by a frame assembly, second means for folding said frame assembly to assume a substantially decreased width when not in use;

mast connecting means mounted on said frame assembly;

a mast connected to said mast connecting means, said mast being universally movable relative to said mast connecting means, third means for folding said mast to assume a substantially decreased length when not in use, said mast being disengageable from said mast connecting means;

a sail attached to said mast; and a boom connected to said mast and said sail, said boom including fourth means for folding said boom to assume a substantially decreased length when not in use, said boom comprising an elongated structure surrounding said sail when in use.

2. The vessel as defined in claim 1 wherein:

each said hull in transverse cross-section being substantially in the shape of a triangle.

3. The vessel as defined in claim 2 wherein said first means comprises:

a plurality of spaced-apart first hinges being included within each of said hull, said first hinges dividing each said hull into a front section and a center section and a rear section, with each said hull in the folded position said front section being located in juxtaposition with said center section and also said rear section being located in juxtaposition with said center position so that said center section is located between said front section and said rear section.

4. The vessel as defined in claim 3 including:

manually operated latching assembly mounted on each said hull, said manually operated latching assembly maintaining each said hull in the non-folded usable position.

5. The vessel as defined in claim 1 wherein:

said second means including a hinge assembly, said frame assembly defining an elongated slot, each said hull having a first longitudinal center axis, said elongated slot having a second longitudinal center axis, said second longitudinal center axis being substantially parallel to said first longitudinal center axis, said mast connecting means being located within said elongated slot.

6. The vessel as defined in claim 5 wherein:

said mast connecting means being movable to different longitudinal positions within said elongated slot and being fixable at any pre-established said longitudinal position.

7. The vessel as defined in claim 1 wherein:

said third means comprising a plurality of hinges, with said mast in the extended position the said hinges only permitting folding of said mast in one direction, whereby force applied to said mast in the opposite direction will maintain said mast in the extended position.

8. The vessel as defined in claim 1 wherein:

said fourth means comprises a hinge joint assembly, said hinge joint assembly dividing said boom into a fore section and an aft section, said aft section being pivotable relative to said fore section when said elongated structure is in the "use" position, said pivoting of said aft section relative to said fore section is so as to relocate said hinge joint assemblies so as to permit pivoting of said aft section to a side-by-side relationship with said fore section.

9. The vessel as defined in claim 8 wherein:

each said hull in transverse cross-section being substantially in the shape of a triangle.

10. The vessel as defined in claim 9 wherein:

a plurality of spaced-apart first hinges being included within each of said hull, said first hinges dividing each said hull into a front section and a center section and a rear section, with said hull in the folded position said front section being located in juxtaposition with said center section and also said rear section being located in juxtaposition with said center position so that said center section is located between said front section and said rear section.

11. The vessel as defined in claim 10 wherein:

manually operated latching assembly mounted on each said hull, said manually operated latching assembly maintaining each said hull in the non-folded usable position.

12. The vessel as defined in claim 11 wherein:

said second means including a hinge assembly, said frame assembly defining an elongated slot, each said hull having a first longitudinal center axis, said elongated slot having a second longitudinal center axis, said second longitudinal center axis being substantially parallel to said first longitudinal center axis, said mast connecting means being located within said elongaged slot.

13. The vessel as defined in claim 12 wherein:

said mast connecting means being movable to different longitudinal positions within said elongated slot and being fixable at any pre-established said longitudinal position.

14. The vessel as defined in claim 13 wherein:

said third means comprising a plurality of hinges, with said mast in the extended position the said hinges only permitting folding of said mast in one direction, whereby the force applied to said mast in the opposite direction will maintain said mast in the extended position.

* * * * *